US009295312B2

(12) United States Patent
Saito

(10) Patent No.: US 9,295,312 B2
(45) Date of Patent: Mar. 29, 2016

(54) REFILL LEAD CASE

(71) Applicant: MITSUBISHI PENCIL COMPANY, LIMITED, Tokyo (JP)

(72) Inventor: Shoichi Saito, Fujioka (JP)

(73) Assignee: MITSUBISHI PENCIL COMPANY, LIMITED, Tokyo (JP)

( * ) Notice: Subject to any disclaimer, the term of this patent is extended or adjusted under 35 U.S.C. 154(b) by 9 days.

(21) Appl. No.: 14/243,930

(22) Filed: Apr. 3, 2014

(65) Prior Publication Data

US 2014/0299499 A1 Oct. 9, 2014

(30) Foreign Application Priority Data

Apr. 5, 2013 (JP) ..... 2013-079844

(51) Int. Cl.
*B65D 47/20* (2006.01)
*A45C 11/34* (2006.01)
*B65D 85/24* (2006.01)

(52) U.S. Cl.
CPC ..... *A45C 11/34* (2013.01); *B65D 85/24* (2013.01)

(58) Field of Classification Search
CPC ..... B65D 1/48; B65D 25/08; B65D 24/17; B65D 47/20
USPC ..... 206/443, 380, 800; 401/86; 220/215, 220/811, 812
See application file for complete search history.

(56) References Cited

U.S. PATENT DOCUMENTS 3,659,758 A * 5/1972 Waterman ..... 222/561
4,811,842 A * 3/1989 Sekiya ..... 206/443
7,114,619 B2 * 10/2006 Ellis et al. ..... 206/540

FOREIGN PATENT DOCUMENTS

JP 2012-91431 A 5/2012

* cited by examiner

*Primary Examiner* — Anthony Stashick
*Assistant Examiner* — Raven Collins
(74) *Attorney, Agent, or Firm* — Westerman, Hattori, Daniels and Adrian, LLP

(57) ABSTRACT

The refill lead case includes a case body provided with an opening portion, a lid attachment member attached to the opening portion of the case body, and a lid body attached to the lid attachment member in a slidable manner. The lid body is provided with a slide operation portion located at the front surface side of the lid attachment member and a bridge portion that is integrally molded with the slide operation portion, protrudes toward the rear surface side of the lid attachment member, and extends in the slide direction of the lid body. The bridge portion includes slope surfaces formed at the left and right sides while ridge lines are centered therebetween. When the lid body takes a downward posture, the refill leads accommodated in the case body are distributed inside the case body with respect to the ridge lines as a boundary.

7 Claims, 16 Drawing Sheets

REFILL LEAD CASE

BACKGROUND OF THE INVENTION

1. Field of the Invention

The present invention relates to a refill lead case that accommodates refill leads for a mechanical pencil.

2. Description of the Related Art

In general, a refill lead case for a mechanical pencil includes a thin and long box-shaped case body that accommodates a plurality of refill leads and a lid body that is attached to the case body in a slidable manner so that a case opening portion of the end portion of the case body in the length direction is opened and closed.

In the refill lead case with the above-described configuration, it is desirable to adjust the refill lead extraction amount when the refill leads are supplied to the mechanical pencil. For example, JP 2012-91431 A discloses a refill lead case capable of adjusting the amount of refill leads extracted from the case body in response to the slide position of the lid body. Further, the slide position of the lid body is also determined by a click feeling.

In this kind of refill lead case, the refill lead case is inverted so that a lead discharge hole is slightly directed downward when the refill leads are extracted from the case body.

At this time, many refill leads accommodated in the case body gather at the lead discharge hole due to the gravity, and hence the refill leads are jammed at the lead discharge hole. As a result, a phenomenon occurs in which the refill leads are not smoothly discharged.

JP 2012-91431A discloses a configuration in which a pillar portion is integrally formed with the lid body, opening and closing an opening portion of the case body in a slidable manner, in a direction perpendicular to the slide direction of the lid body and the refill lead accommodation position inside the case body is controlled by the pillar portion.

However, the pillar portion is formed so as to prevent the breakage of the refill leads in the case body due to the slide operation of the lid body, and hence an effect that contributes to the smooth refill lead discharge operation when the refill leads are extracted from the case body may not be expected.

SUMMARY OF THE INVENTION

An object of the invention is to solve a problem in which the refill leads are jammed when many refill leads accommodated in a case body gather at a lead discharge hole as described above in a case where the refill leads are extracted from the refill lead case, and provide a refill lead case capable of smoothly discharging refill leads.

In order to solve the above-described problems, a refill lead case according to the invention includes: a case body that includes an opening portion formed at a part thereof and accommodates a plurality of refill leads therein; a lid attachment member that is attached to the opening portion of the case body and includes a lead discharge hole; and a lid body that is attached to the lid attachment member in a slidable manner, wherein the lead discharge hole is opened and closed when the lid body is slid relative to the lid attachment member, the lid body is provided with a slide operation portion that is located at the front surface side of the lid attachment member and a bridge portion that is integrally molded with the slide operation portion, protrudes toward the rear surface side of the lid attachment member, and extends in the slide direction of the lid body, and wherein the bridge portion is provided with left and right slope surfaces while a ridge line is centered therebetween, the ridge line is formed in a direction perpendicular to the length direction of the case body, and when the lid body takes a posture in which the lid body is directed downward, the refill leads accommodated in the case body are distributed inside the case body with respect to the ridge line as a boundary.

In this case, desirably, the lid body is formed by integrally molding the slide operation portion that is located at the front surface side of the lid attachment member through a neck portion moving inside a slit formed in the lid attachment member, the bridge portion that protrudes toward the rear surface side of the lid attachment member through the neck portion, and a slide contact portion that contacts the rear surface side of the lid attachment member through the neck portion, and the separation of the lid body from the lid attachment member is prevented by the slide contact portion.

In addition, the rear surface side of the lid attachment member is provided with a plurality of concave portions formed along the slit, a front end portion of the bridge portion in the lid body is provided with a convex portion that faces the concave portions formed in the lid attachment member, and when the convex portion selectively engages with the plurality of concave portions, the slide position of the lid body with respect to the lid attachment member is selected.

In this case, more desirably, a click action is generated in the slide operation of the lid body by a spring action of the bridge portion extending in the slide direction of the lid body.

Further, desirably, a lead discharge hole is formed by a notch termination end portion of the slit formed in the lid attachment member, and a degree of opening of the lead discharge hole is adjustable in response to the slide position of the lid body with respect to the lid attachment member.

According to the refill lead case with the above-described configuration, the bridge portion that protrudes toward the inside of the case body is integrally molded with the lid body that opens and closes the lead discharge hole by the slide operation. The bridge portion includes the slope surfaces formed at the left and right sides while the ridge line are centered therebetween, and at least a part of the ridge line is formed in a direction perpendicular to the length direction of the case body. Accordingly, in a case where the lid body takes a downward posture in order to extract the refill leads from the refill lead case, the refill leads accommodated in the case body are distributed inside the case body with respect to the ridge line as a boundary.

Thus, it is possible to prevent a state in which many refill leads accommodated in the case body gather at the lead discharge hole when the refill leads are extracted from the refill lead case, and hence to prevent a problem in which the refill leads are jammed at the lead discharge hole. Accordingly, it is possible to provide the refill lead case capable of smoothly discharging the refill leads.

DESCRIPTION OF THE PREFERRED EMBODIMENTS

Figure 1:
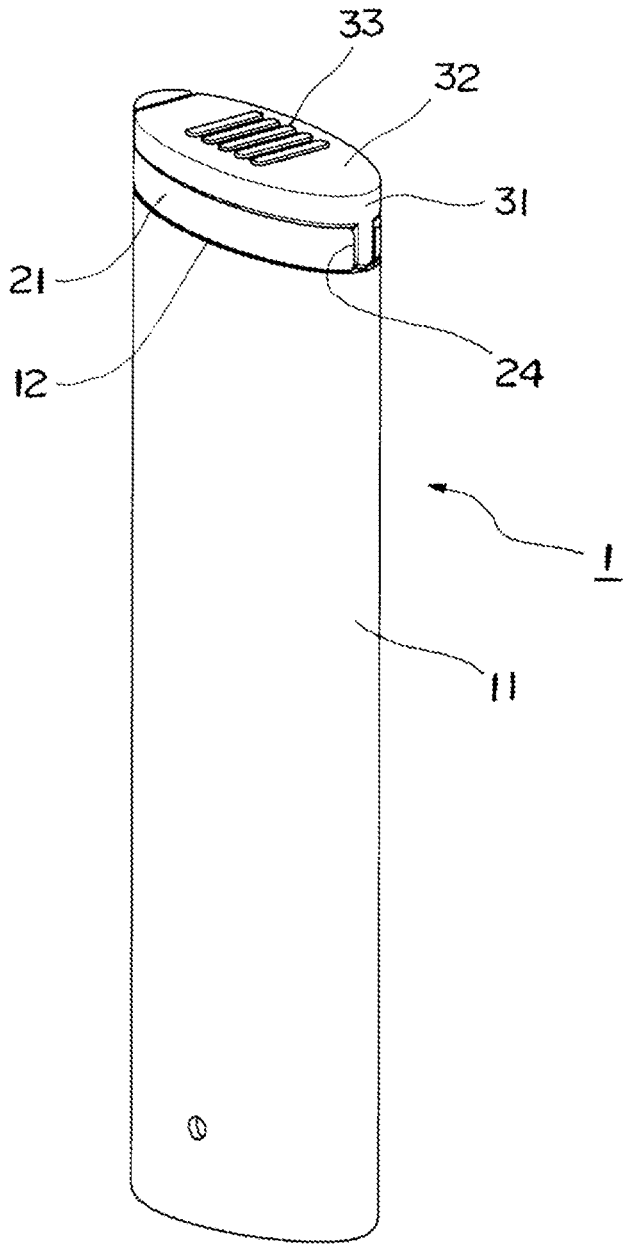
FIG. 1 is a perspective view illustrating an external configuration of a refill lead case according to the invention.

Hereinafter, a refill lead case according to the invention will be described based on the embodiments illustrated in the drawings.

Figure 2:
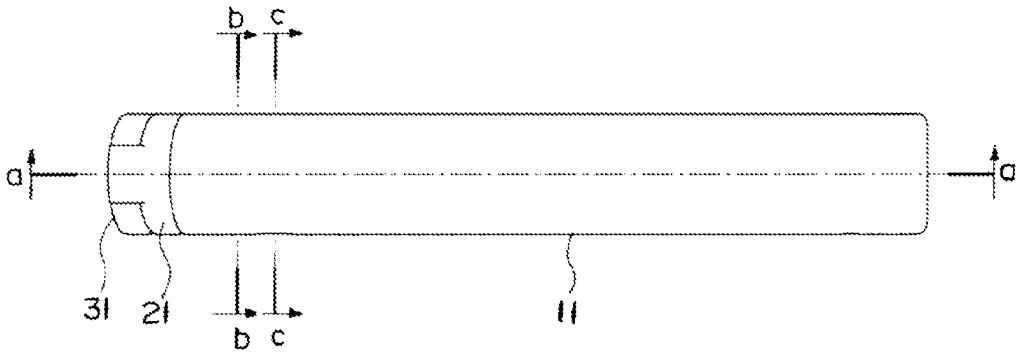
FIG. 2 is a rear view illustrating the refill lead case in the state illustrated in FIG. 1 when viewed from a rear surface side.
Figure 3:
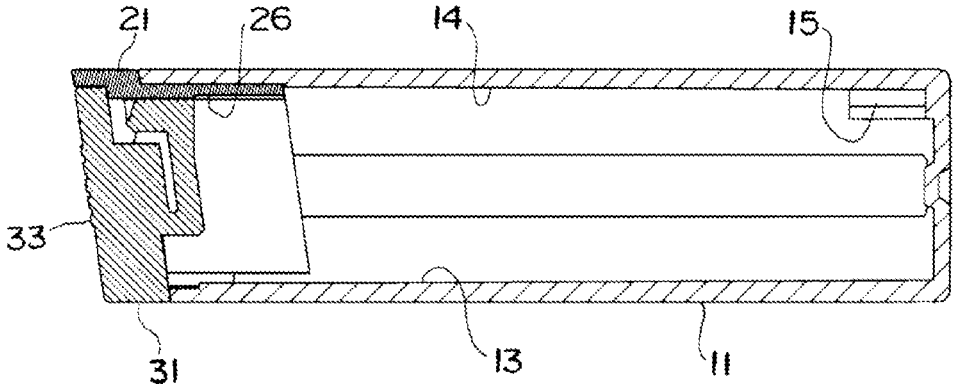
FIG. 3 is a cross-sectional view taken along the line a-a of FIG. 2 when viewed in the arrow direction.
Figure 4:
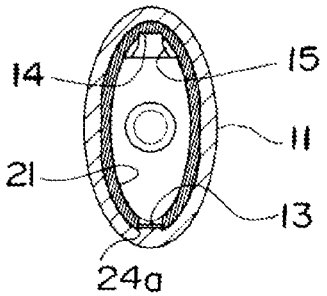
FIG. 4 is a cross-sectional view taken along the line b-b of FIG. 2 when viewed in the arrow direction.
Figure 5:
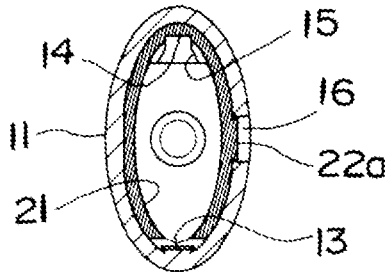
FIG. 5 is a cross-sectional view taken along the line c-c of FIG. 2 when viewed in the arrow direction.

FIG. 1 is a perspective view illustrating an external configuration of a refill lead case 1 when viewed from the front side, FIG. 2 is a rear view illustrating the external configuration thereof when viewed from the rear surface side thereof, and FIGS. 3 to 5 are cross-sectional views illustrating a main part of the refill lead case 1.

As illustrated in these drawings, the refill lead case 1 is formed in a thin and long shape as a whole, and the cross-section perpendicular to the length direction is formed in an oval shape. Then, a case body 11 capable of accommodating multiple refill leads is formed so that the bottom portion is closed and the upper end portion is provided with an opening portion 12, and a lid attachment member 21 is attached while contacting the inside of the opening portion 12.

Further, as illustrated in FIG. 1, a lid body 31 is attached to the lid attachment member 21 in a slidable manner by the use of a slit 24 formed in the lid attachment member 21. Furthermore, a slide operation portion 32 of the front surface of the lid body 31 is provided with a slip prevention protrusion 33 which is formed in a stripe shape in a direction perpendicular to the slide direction of the lid body.

Figure 6:
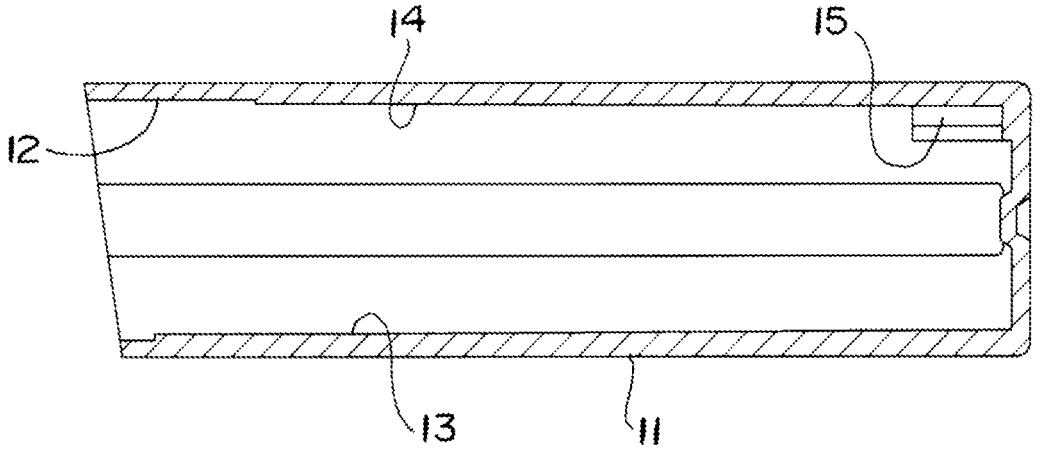
FIG. 6 is a center cross-sectional view of a case body.
Figure 7:
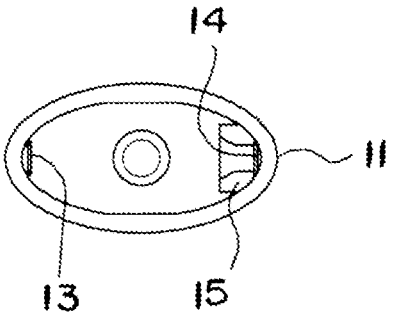
FIG. 7 is a front view in which an opening portion of the case body is located on the viewer side.
Figure 8:
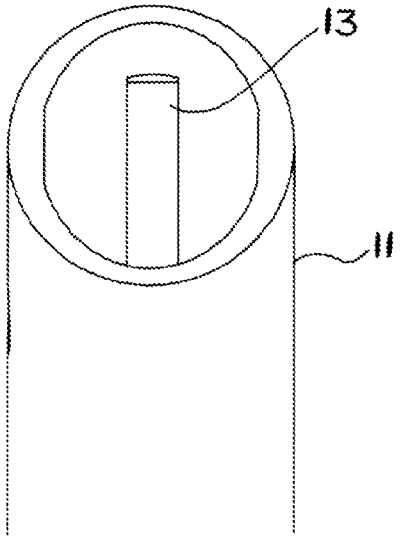
FIG. 8 is a perspective view in which the opening portion of the case body is viewed from the obliquely upward side.
Figure 9:
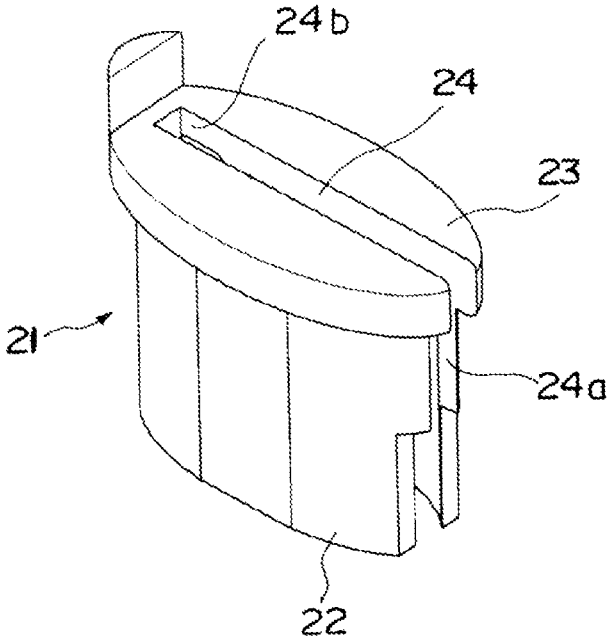
FIG. 9 is a perspective view of a lid attachment member.

The case body 11 is formed of a transparent or translucent resin material. Then, as illustrated in FIGS. 6 to 8, the opening portion 12 is formed in a slightly thin shape, and is provided with an inner wall surface to which the lid attachment member 21 is attached.

Further, one side of the case body 11 having an oval cross-section in the long radial direction is provided with a pillar portion 13 that is formed in the length direction of the case body so that the notch start end portion of the slit formed in the lid attachment member 21, which will be described later, is relatively inserted into the case body.

Further, the other side of the case body 11 facing the pillar portion 13 in the long radial direction is provided with a plane portion 14 which is thin and long in the length direction of the case body 11, and the vicinity of the bottom portion inside the case body 11 is provided with a pair of wall surface portions 15 that faces each other, interposes the thin and long plane portion 14 and has a slope surface at both sides thereof. Furthermore, in this embodiment, the gap between the facing wall surface portions 15 is set to 2 mm.

Further, as illustrated in FIG. 5, a part of the peripheral side wall near the opening portion 12 of the case body 11 is provided with a fitting window hole 16 that holds the lid attachment member 21.

FIGS. 9 to 12 illustrate a single configuration of the lid attachment member 21. The lid attachment member 21 includes an oval cylindrical body portion 22 that is attached while contacting the inner wall surface of the opening portion 12 of the case body 11 and an oval flange portion 23 that is integrally molded with the cylindrical body portion 22 and contacts the edge of the opening portion 12 of the case body 11.

Then, the lid attachment member 21 is provided with the slit 24 in which the peripheral edge portion contacting the case body 11 is formed as the notch start end portion.

That is, the slit 24 forms the end portions of the oval flange portion 23 and the oval cylindrical body portion 22 in the long radial direction as the notch start end portion 24*a*, and a notch termination end portion 24*b* is formed at a position close to the other end portion in the long radial direction.

The slit 24 that is formed in the lid attachment member 21 serves to attach the lid body 31 thereto in a slidable manner as will be described later, and the notch termination end portion 24*b* serves as a refill lead discharge hole as will be described later.

Figure 11:
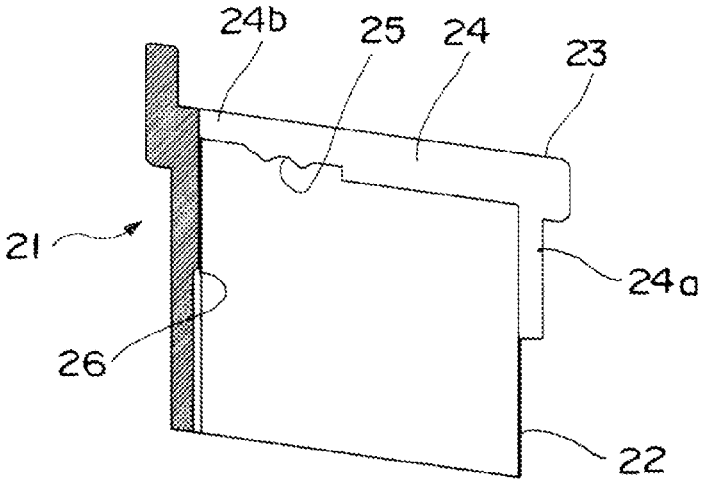
FIG. 11 is a cross-sectional view in which the slit of the lid attachment member is centered.
Figure 12:
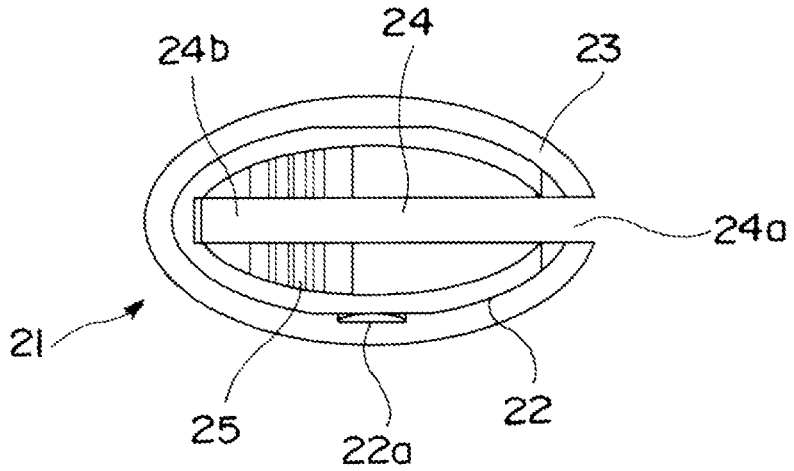
FIG. 12 is a bottom view of the lid attachment member.
Figure 13:
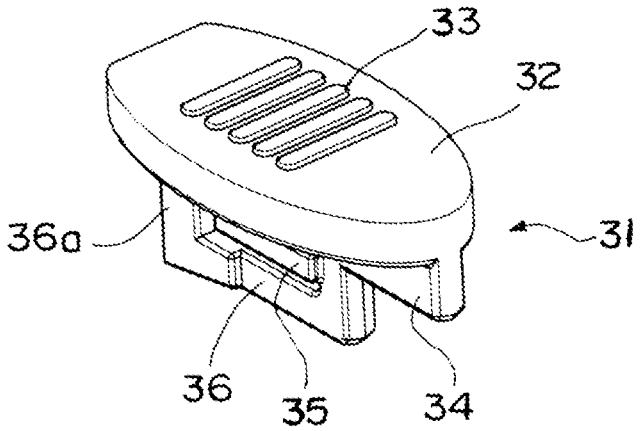
FIG. 13 is a perspective view of a lid body.
Figure 14:
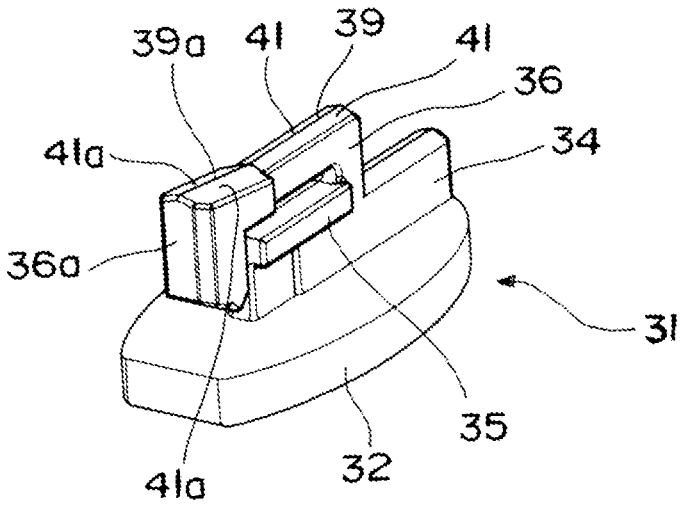
FIG. 14 is a perspective view illustrating a state where the lid body illustrated in FIG. 13 is inverted.
Figure 15:
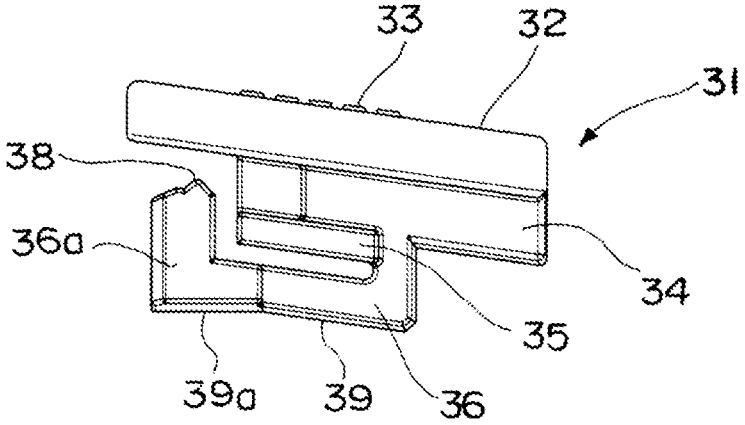
FIG. 15 is a side view of the lid body.
Figure 16:
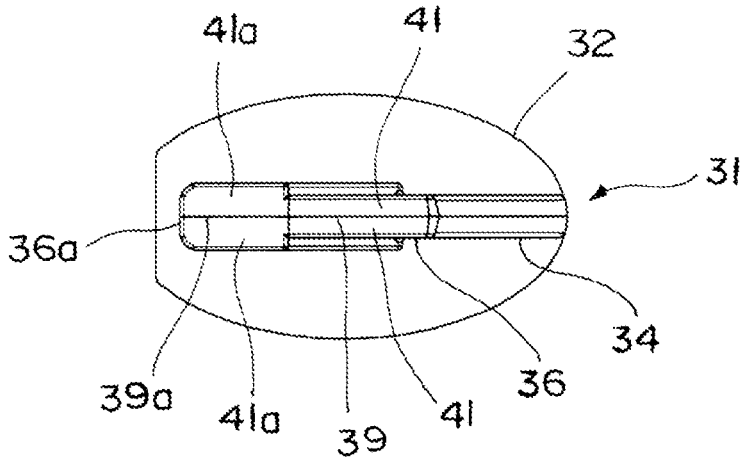
FIG. 16 is a bottom view of the lid body.
Figure 17:
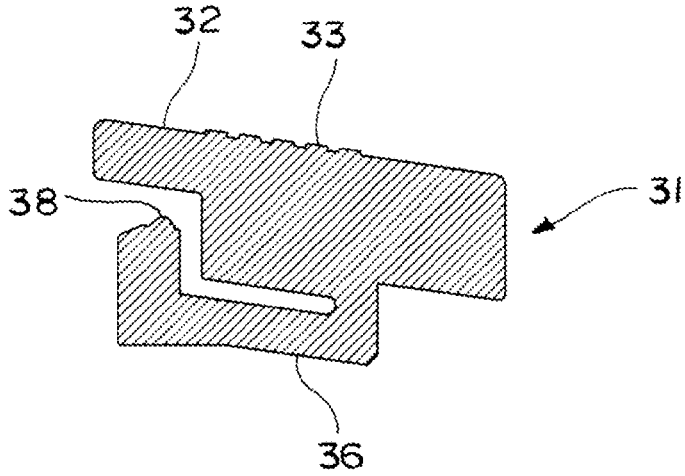
FIG. 17 is a center cross-sectional view of the lid body.

As illustrated in FIGS. 11 and 12, the rear surface side of the lid attachment member 21, that is, the surface of the flange portion 23 facing the case body 11 is provided with a plurality of concave portions 25 that are formed along both sides of the slit 24. The concave portions 25 serve to position the lid body 31 in the slide direction when the lid body 31 is attached to the lid attachment member 21 in a slidable manner.

Furthermore, in this embodiment, the concave portions 25 are formed at three positions along both sides of the slit 24, and the reference numeral 25 of FIGS. 11 and 12 indicates the center concave portion.

As illustrated in FIGS. 3 and 11, the inner peripheral surface of the cylindrical body portion 22 in the lid attachment member 21, that is, the end portion of the oval cylindrical body portion 22 in the long radial direction is provided with a step portion 26. It is desirable that a difference in the height dimension of the step portion 26 be smaller than the diameter of the refill lead accommodated in the case body 11. In this embodiment, a difference in the height dimension of the step portion 26 is set to 0.3 mm.

The step portion 26 serves to latch at least one refill lead accommodated in the case body when the refill lead is discharged from the refill lead case 1, and this operation will be described later in detail.

As illustrated in FIG. 11, the notch termination end portion 24*b* of the slit 24 is located on the extension line in the length direction of the refill lead latched by the step portion 26. As described above, in this embodiment, when the lid body 31 is slid, the notch termination end portion 24*b* of the slit 24 also serves as the lead discharge hole (which is indicated by the same reference numeral as that of the notch termination end portion 24*b*).

Figure 10:
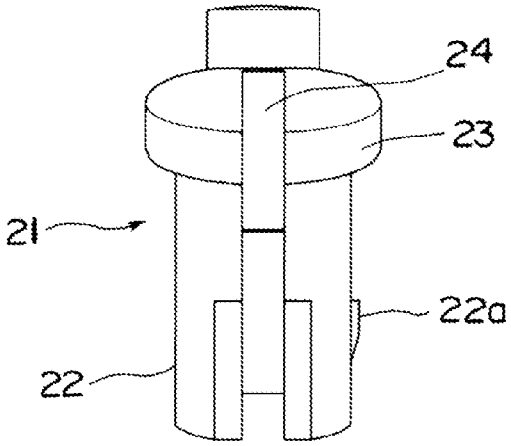
FIG. 10 is a front view in which the lid attachment member is viewed from a notch start end portion of a slit.

Further, as illustrated in FIGS. 10 and 12, the outer surface of the cylindrical body portion 22 of the lid attachment member 21 is provided with a protrusion 22*a*, and the protrusion 22*a* is provided with a tapered slope surface. When the cylindrical body portion 22 of the lid attachment member 21 is attached to the opening portion 12 of the case body 11, the protrusion 22*a* is inserted and fitted into the window hole 16 formed in the case body 11. Accordingly, the lid attachment member 21 is attached to the case body 11.

FIGS. 13 to 17 illustrate a single configuration of the lid body 31.

As described above, the lid body 31 includes the slide operation portion 32 that is formed in an oval shape, and a neck portion 34 that is molded in a thin plate shape is formed so as to be orthogonally upright from the rear surface of the slide operation portion 32. Then, the slide contact portion 35 contacting the rear surface side of the lid attachment member 21 is integrally molded so as to be projected toward both outsides of the neck portion 34.

That is, when the neck portion 34 is inserted into the slit 24 formed in the lid attachment member 24, the lid body 31 is attached to the lid attachment member 24 in a slidable manner. When the slide contact portion 35 that protrudes toward both outsides of the neck portion 34 contacts the rear surface side of the lid attachment member 24, the separation of the lid body 31 from the lid attachment member 24 is prevented.

In the lid body 31, the neck portion 34 is integrally molded with a bridge portion 36 that protrudes toward the rear surface side of the lid attachment member 21 and extends in the slide direction of the lid body 31 while being attached to the lid attachment member 21 in a slidable manner.

Moreover, the front end portion of the bridge portion 36 is formed as a thick portion 36*a* that faces the rear surface side of the lid body 31, and the front end portion of the thick portion 36*a* is provided with a wedge-shaped convex portion 38.

Meanwhile, the bridge portion 36 also includes the thick portion 36*a*, and ridge lines 39 and 39*a* are formed in the slide direction. Here, slope surfaces 41 and 41*a* are respectively formed at the left and right sides of the bridge portions 36 and 36*a* while the ridge lines 39 and 39*a* are located at the center position.

In this embodiment, the angle formed by intersecting the left and right slope surfaces disposed with the ridge lines located at the center position is set to 140°. Further, the ridge line 39*a* that is formed in the thick portion 36*a* of the bridge portion 36 among the ridge lines is formed in a direction substantially perpendicular to the length direction of the case body 11 when the case body 11 is assembled as the refill lead case 1.

In the refill lead case 1 that includes the case body 11, the lid attachment member 21, and the lid body 31, the thin-plate-shaped neck portion 34 in the lid body 31 is first inserted into the notch start end portion 24*a* of the slit 24 formed in the lid attachment member 21 in order to assemble the case body 11, the lid attachment member 21, and the lid body 31. Then, the cylindrical body portion 22 of the lid attachment member 21 is inserted into the opening portion 12 of the case body 11 in the axial direction in a state where the oval flange portion 23 of the lid attachment member 21 and the oval slide operation portion 32 of the lid body 31 overlap each other in the vertical direction.

By this operation, the fitting protrusion 22*a* that is formed in the cylindrical body portion 22 of the lid attachment member 21 is fitted into the fitting window hole 16 formed in the vicinity of the opening portion 12 of the case body 11. Accordingly, the lid attachment member 21 is attached to the case body 11.

At this time, as illustrated in FIG. 4, the end portion of the pillar portion 13 formed inside the case body 11 is relatively inserted into the notch start end portion 24*a* of the slit 24 formed in the lid attachment member 21. Accordingly, the slit 24 that is formed in the lid attachment member 21 ensures a predetermined gap by the pillar portion 13 in the case body 11, and hence prevents the inward deformation of the slit 24.

Thus, when the lid attachment member 21 is attached to the case body 11, both the fitting window hole 16 of the case body 11 and the fitting protrusion 22*a* of the lid attachment member 21 are strongly coupled to each other by the action therebetween, thereby preventing a problem such as a backlash therebetween.

Then, the lid body 31 that is attached to the lid attachment member 21 in a slidable manner may be prevented from being separated from the lid attachment member 21 by the action of the slide contact portion 35 that is integrally molded with the neck portion 34.

Further, since the slit 24 that is formed in the lid attachment member 21 ensures a predetermined gap by the pillar portion 13, the smooth slide operation of the lid body 31 may be guaranteed.

Figure 19A:
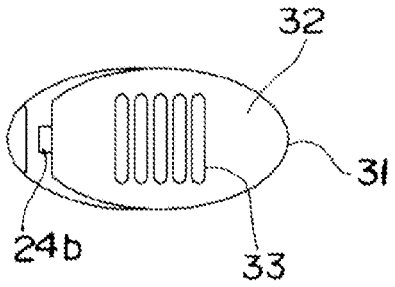
FIG. 19A is a top view of the refill lead case in a state where the lid body is opened by a first level.
Figure 19B:
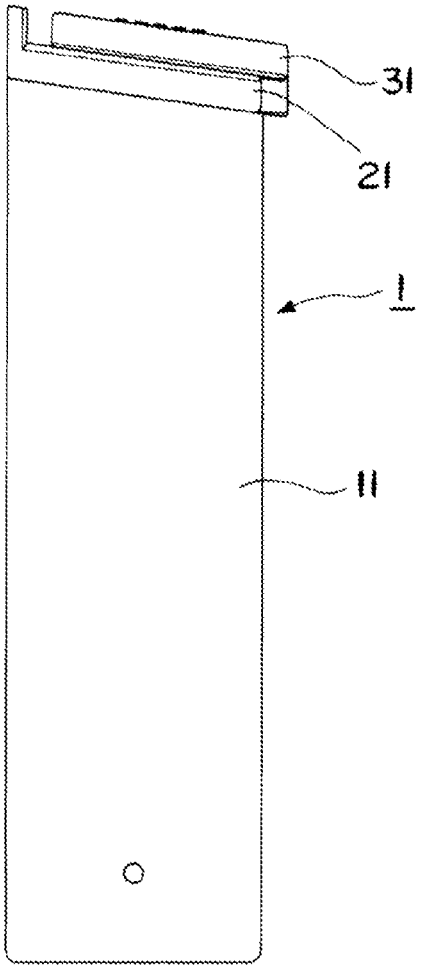
FIG. 19B is a front view of the refill lead case in a state where the lid body is opened by a first level.
Figure 19C:
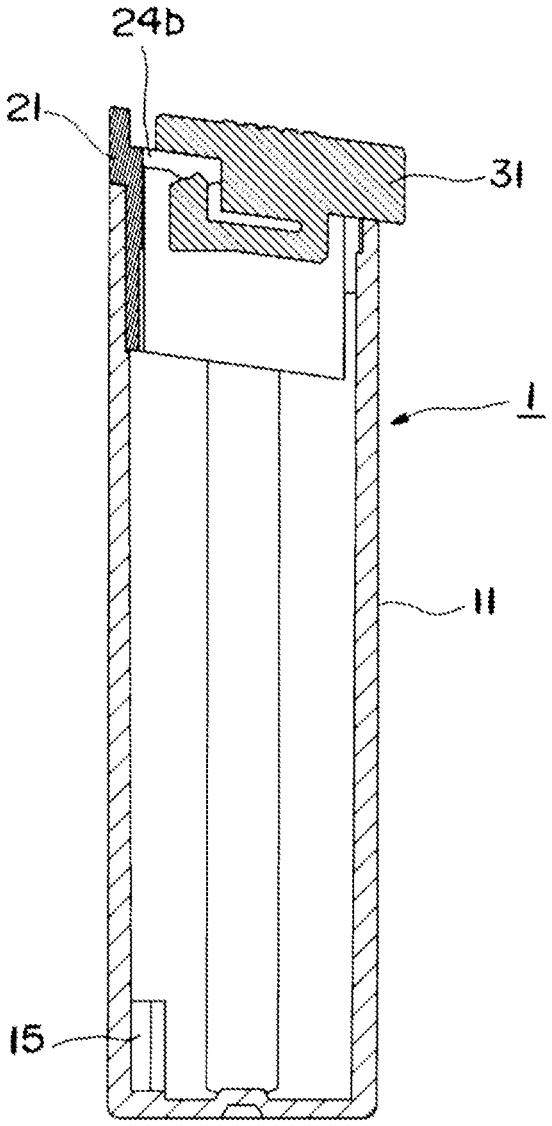
FIG. 19C is a center cross-sectional view of the refill lead case in a state where the lid body is opened by a first level.
Figure 20A:
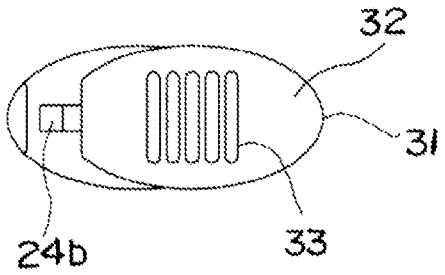
FIG. 20A is a top view of the refill lead case in a state where the lid body is opened by a second level.
Figure 20B:
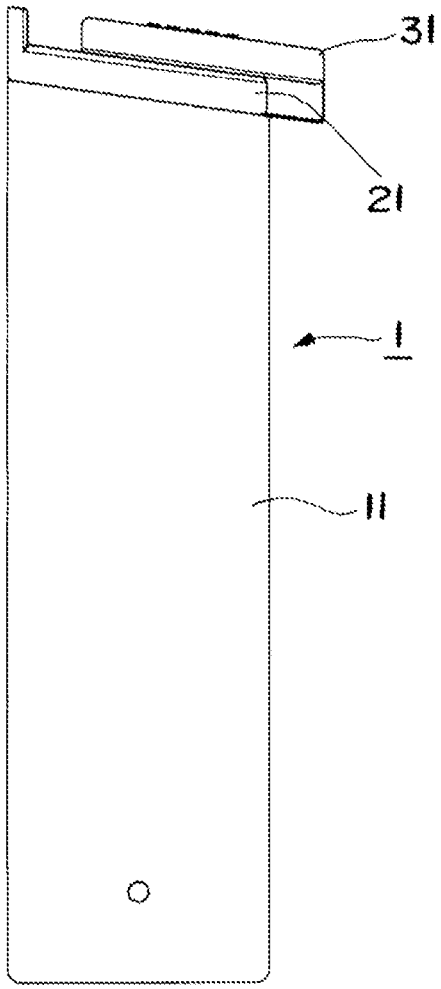
FIG. 20B is a front view of the refill lead case in a state where the lid body is opened by a second level.
Figure 20C:
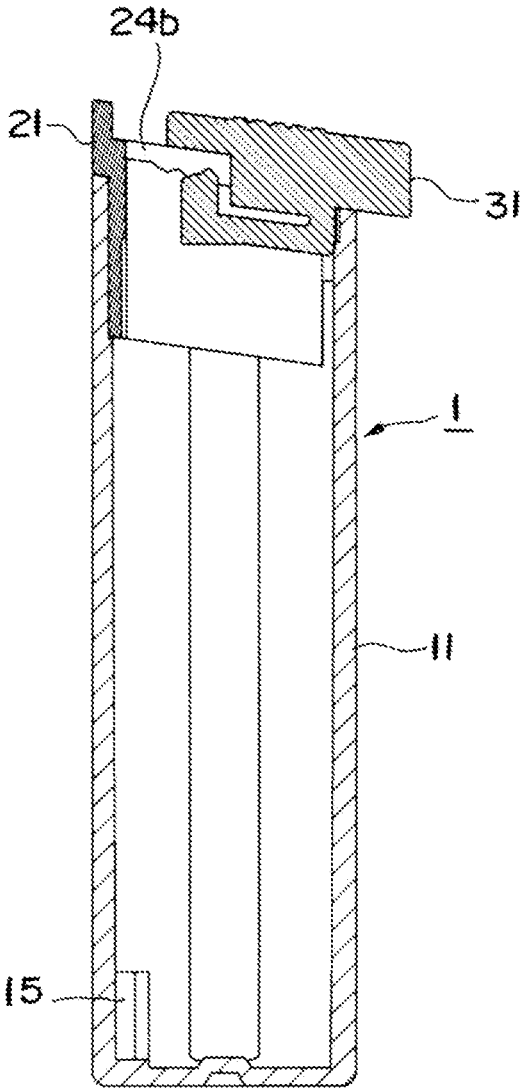
FIG. 20C is a center cross-sectional view of the refill lead case in a state where the lid body is opened by a second level.
Figure 21:
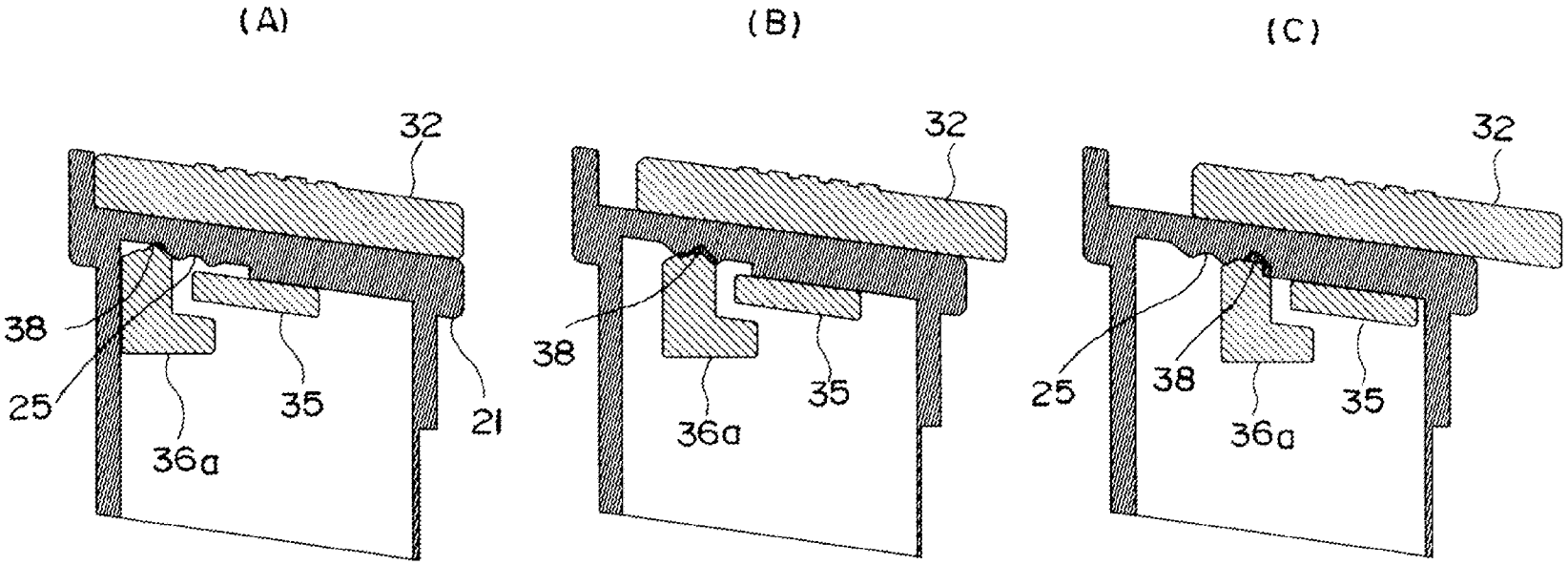
FIGS. 21A to 21C are cross-sectional views illustrating a procedure of a slide state of the lid body with respect to the lid attachment member.

FIGS. 18A to 20C illustrate a slide state of the lid body 31 in the refill lead case 1, and FIGS. 21A to 21C sequentially illustrate a main part thereof.

Figure 18A:
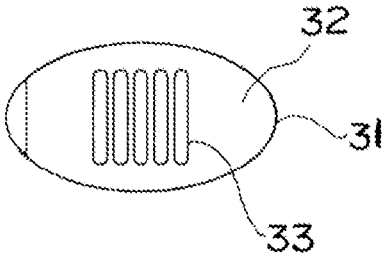
FIG. 18A is a top view of the refill lead case in a state where the lid body is closed.
Figure 18B:
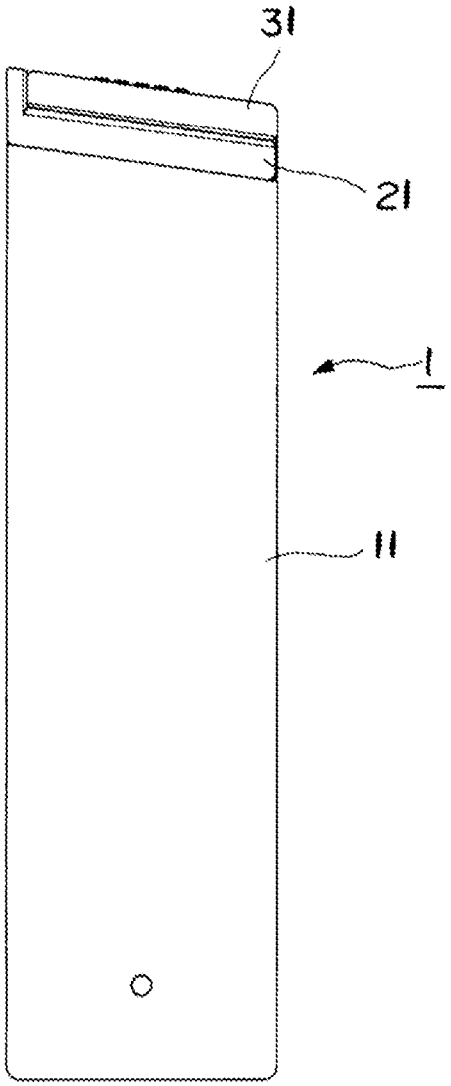
FIG. 18B is a front view of the refill lead case in a state where the lid body is closed.
Figure 18C:
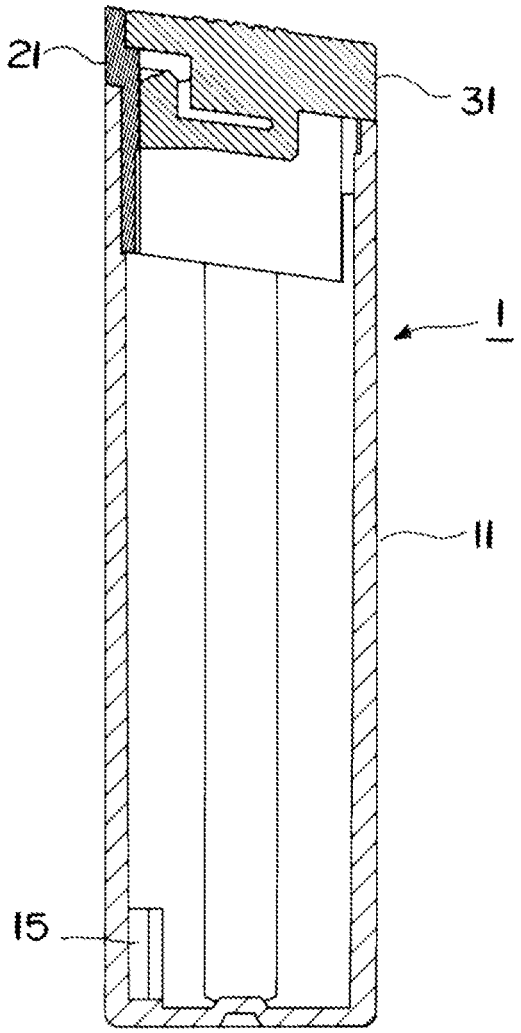
FIG. 18C is a center cross-sectional view of the refill lead case in a state where the lid body is closed.

FIGS. 18A to 18C illustrate a state where the lid body 31 is closed. In this state, as illustrated in FIG. 21A, the wedge-shaped convex portion 38 formed in the thick portion 36*a* of the bridge portion 36 engages with the inward concave portion 25 that is formed in the rear surface of the lid attachment member 21 in the slide direction.

FIGS. 19A to 19C illustrate a state where the lid body 31 is slid so that the lid body 31 is opened by a first level. In this state, as illustrated in FIG. 21B, the wedge-shaped convex portion 38 engages with the center concave portion 25 formed in the lid attachment member 21 in the slide direction.

In this state, as illustrated in FIG. 19A, the notch termination end portion 24*b* of the slit 24 formed in the lid attachment member 21 is exposed by the movement of the slide operation portion 32. Then, as illustrated in FIG. 21B, the thick portion 36*a* slightly moves toward the center portion. Accordingly, the lead discharge hole 24*b* with a small opening is formed in the refill lead case 1.

FIGS. 20A to 20C illustrate a state where the lid body 31 is further slid so that the lid body 31 is opened by a second level. In this state, as illustrated in FIG. 21C, the wedge-shaped convex portion 38 engages with the concave portion 25 in the front side formed in the lid attachment member 21 in the slide direction.

In this state, as illustrated in FIG. 20A, the exposure degree of the notch termination end portion 24*b* of the slit 24 formed in the lid attachment member 21 increases by the further movement of the slide operation portion 32. Then, as illustrated in FIG. 21C, the thick portion 36*a* further moves toward the center portion. Accordingly, the lead discharge hole 24*b* with a large opening is formed in the refill lead case 1.

In the refill lead case 1 in which the lid body 31 moves in a slidable manner, the bridge portion 36 that supports the wedge-shaped convex portion 38 integrally molded with the lid body 31 is applied with a spring action that presses the convex portion 38 against the concave portion 25 near the lid attachment member 21. Accordingly, a click action is generated in the slide operation of the lid body 31, and hence the lid body 31 is positioned in the slide direction.

Incidentally, the case body 11 of the refill lead case 1 is molded by a resin material as described above, and hence the static electricity generation degree is high as widely known. Thus, a problem arises in that an operation of extracting the refill lead from the refill lead case 1 is disturbed due to the influence of the static electricity.

Figure 22:
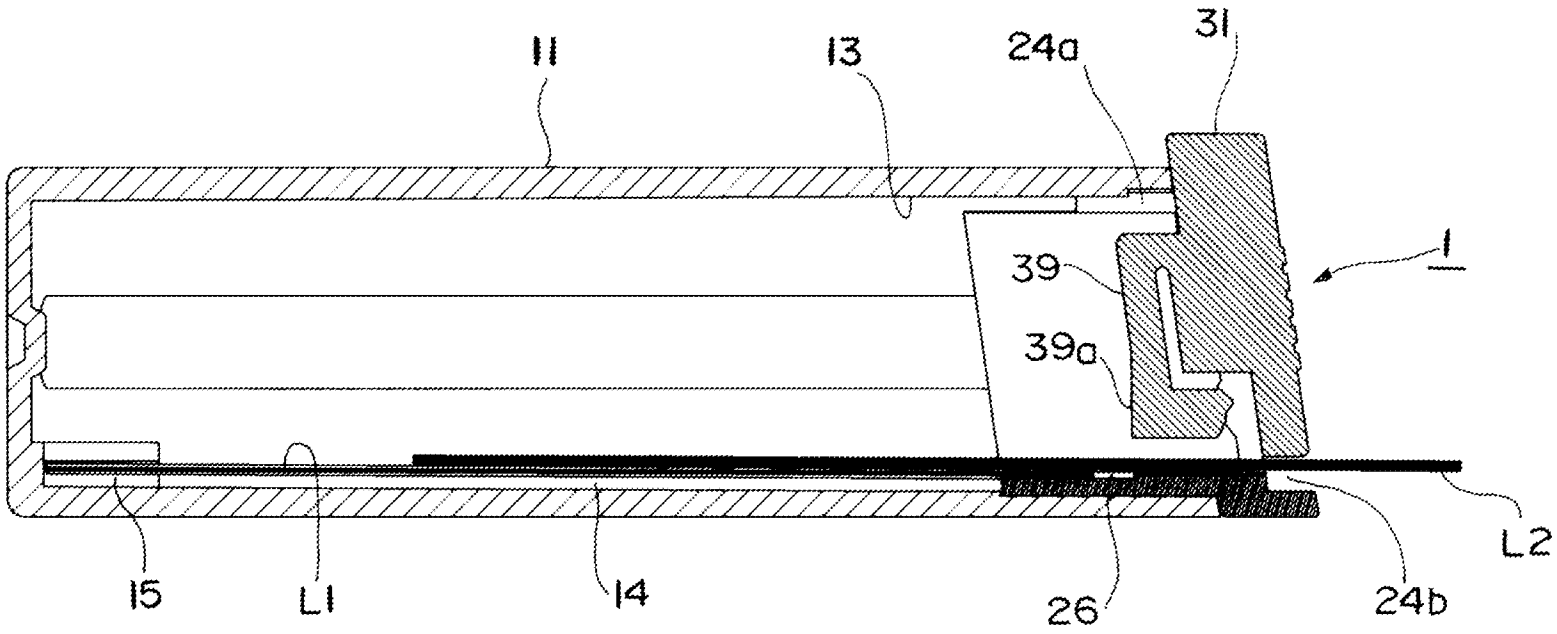
FIG. 22 is a cross-sectional view of the refill lead case in a state where a refill lead is extracted from the case.

FIG. 22 illustrates the refill lead case 1 according to the invention that may solve the operation problem caused by the static electricity. Here, as illustrated in FIGS. 19A to 19C, the lid body 31 is opened by a first level.

In a case where the refill lead is extracted from the refill lead case 1, the lead discharge hole 24*b* generally takes a posture in which the lead discharge hole is directed downward as illustrated in FIG. 22.

In this case, the step portion 26 is formed at a position directly near the lead discharge hole 24*b* as described above, and the height dimension of the step portion 26 is set to 0.3 mm as described above. Further, as described above, the bottom portion inside the case body 11 is provided with the pair of wall surface portions 15 that faces each other, interposes the thin and long plane portion 14 therebetween and includes slope surfaces at both sides, and the gap between the wall surface portions 15 is set to 2 mm.

In the current standard, the refill lead that is accommodated in the refill lead case 1 has a diameter of any one of 0.5 mm, 0.7 mm, and 0.9 mm. Accordingly, when the refill lead case 1 takes the posture illustrated in FIG. 22, the refill lead is latched by the step portion 26, and two or three refill leads L1 are arranged in parallel along the thin and long plane portion 14.

In this state, when the lead discharge hole 24*b* is inclined downward, the other refill lead L2 is discharged from the lead discharge hole 24*b* while sliding on the refill lead L1 latched by the step portion 26.

In this case, since the refill leads L1 and L2 are formed of the same material, an adsorption action caused by the static electricity does not occur therebetween, and hence the refill lead L2 is smoothly discharged from the lead discharge hole 24*b* without the influence of the static electricity.

Furthermore, since the height dimension of the step portion 26 is set to 0.3 mm, the last one of the refill leads accommodated in the refill lead case 1 may be also extracted from the lead discharge hole 24*b* without the influence of the step portion 26.

Moreover, in the refill lead case 1, as described above, the bridge portion 36 formed in the lid body 31 also includes the thick portion 36*a*, the ridge lines 39 and 39*a* are formed in the slide direction, and the slope surfaces 41 and 41*a* are respectively formed at the left and right sides while the ridge lines 39 and 39*a* are centered. In addition, the ridge line 39*a* that is formed in the thick portion 36*a* of the bridge portion 36 is formed in a direction substantially perpendicular to the length direction of the case body 11.

Thus, when the lid body 31 takes a downward posture, the refill leads accommodated in the case body 11 are distributed inside the case body 11 with respect to the ridge lines 39 and 39*a* as the boundary.

Accordingly, in a case where the refill leads are extracted, it is possible to effectively prevent a problem in which most of the refill leads accommodated in the case body 11 gather in the vicinity of the lead discharge hole 24*b* and the refill leads are jammed at the position. Particularly, in this embodiment, as illustrated in FIG. 22, the ridge line 39 of the bridge portion 36 is formed so as to be directed slightly downward toward the lead discharge hole 24*b*.

In contrast, the ridge line 39*a* that is formed in the thick portion 36*a* is formed in a direction substantially perpendicular to the length direction of the case body 11, and hence it is possible to effectively prevent the refill leads from gathering the vicinity of the lead discharge hole 24*b* by the shape of the ridge line 39*a*. Accordingly, the refill leads may be extracted more smoothly.

The above-described refill lead case according to the invention is characterized in that it includes a configuration described in the section related to the means for solving the problem, and hence may obtain a unique effect as described in the section related to the advantageous effects of the invention.

What is claimed is:

1. A refill lead case comprising:

a case body that includes an opening portion formed at a part thereof and accommodates a plurality of refill leads therein;

a lid attachment member that is attached to the opening portion of the case body and includes a lead discharge hole at a forward side of the lid attachment member; and a lid body that is attached to the lid attachment member in a slidable manner such as to slide in a slide direction extending between forward and rearward sides of the case body, wherein the lead discharge hole is opened and closed when the lid body is slid relative to the lid attachment member, the lid body is provided with a slide operation portion that is located at an upper surface side of the lid attachment member and arranged to open and close said lead discharge hole and a bridge portion that is integrally molded with the slide operation portion that protrudes toward a lower surface side of the lid attachment member and that extends in the slide direction of the lid body, and the bridge portion is provided with left and right slope surfaces while a ridge line is centered therebetween, the ridge line is formed in a direction generally perpendicular to the length direction of the case body and generally parallel to said slide direction, and when the lid body takes a posture in which the lid body is directed downward, the refill leads accommodated in the case body are distributed inside the case body with respect to the ridge line as a boundary such as to move laterally to the left and right sides and not to gather in the vicinity of the lead discharge hole.

2. The refill lead case according to claim 1, wherein the lid body is formed by integrally molding the slide operation portion that is located at the upper surface side of the lid attachment member through a neck portion moving inside a slit formed in the lid attachment member, the bridge portion that protrudes toward the lower surface side of the lid attachment member through the neck portion, and a slide contact portion that contacts the lower surface side of the lid attachment member through the neck portion, and wherein the separation of the lid body from the lid attachment member is prevented by the slide contact portion.

3. The refill lead case according to claim 2, wherein the lower surface side of the lid attachment member is provided with a plurality of concave portions formed along the slit, a distal end portion of the bridge portion in the lid body is provided with a convex portion that faces the concave portions formed in the lid attachment member, and when the convex portion selectively engages with the plurality of concave portions, the slide position of the lid body with respect to the lid attachment member is selected.

4. The refill lead case according to claim 3, wherein a click action is generated in the slide operation of the lid body by a spring action of the bridge portion extending in the slide direction of the lid body.

5. The refill lead case according to claim 2, wherein the lead discharge hole is formed by a notch termination end portion of the slit formed in the lid attachment member, and a degree of opening of the lead discharge hole is adjustable in response to the slide position of the lid body with respect to the lid attachment member.

6. The refill lead case according to claim 3, wherein the lead discharge hole is formed by a notch termination end portion of the slit formed in the lid attachment member, and a degree of opening of the lead discharge hole is adjustable in response to the slide position of the lid body with respect to the lid attachment member.

7. The refill lead case according to claim 4, wherein the lead discharge hole is formed by a notch termination end portion of the slit formed in the lid attachment member, and a degree of opening of the lead discharge hole is adjustable in response to the slide position of the lid body with respect to the lid attachment member.

* * * * *